US007673769B2

(12) United States Patent
McRorie, III

(10) Patent No.: US 7,673,769 B2
(45) Date of Patent: Mar. 9, 2010

(54) STORAGE BIN WITH MOVEABLE LID AND ATTACHED SCOOP

(75) Inventor: Robert G. McRorie, III, Huntersville, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 521 days.

(21) Appl. No.: 11/275,026

(22) Filed: Dec. 2, 2005

(65) Prior Publication Data

US 2006/0124653 A1 Jun. 15, 2006

Related U.S. Application Data

(60) Provisional application No. 60/632,874, filed on Dec. 3, 2004.

(51) Int. Cl.
*B65D 41/56* (2006.01)

(52) U.S. Cl. ..... 220/735; 220/212; 220/254.3; 220/254.9; 220/345.1; 220/351; 220/812; 215/391

(58) Field of Classification Search ..... 206/229, 206/230; 215/390, 391, DIG. 5; 220/212, 220/212.5, 254.1, 324, 351, 697, 735, 811, 220/812, 836, 840, 908, 345.1; 222/575; 294/55; D9/436; D30/162; D3/294
See application file for complete search history.

(56) References Cited

U.S. PATENT DOCUMENTS 264,072 A * 9/1882 French ..... 294/55
1,511,613 A * 10/1924 Joern ..... 232/43.1
1,694,119 A * 12/1928 Frank ..... 141/381
1,703,185 A * 2/1929 White ..... 215/227
2,101,375 A * 12/1937 Vanderveld ..... 222/336
2,738,900 A * 3/1956 Wenger ..... 141/380
3,624,787 A * 11/1971 Newman ..... 220/212
3,722,779 A * 3/1973 Chang ..... 220/574
3,840,261 A * 10/1974 Fulkerson et al. ..... 294/55
4,260,069 A * 4/1981 Juergens ..... 220/812
4,458,960 A * 7/1984 Dunst ..... 312/138.1
4,555,045 A * 11/1985 Rodth et al. ..... 222/1
4,878,596 A * 11/1989 Cawley et al. ..... 220/812
5,090,572 A * 2/1992 DeRoseau ..... 206/542
5,092,484 A * 3/1992 Daugherty et al. ..... 220/812
5,236,022 A * 8/1993 Husted ..... 141/358
5,460,293 A * 10/1995 Erickson ..... 220/735
5,577,462 A * 11/1996 Korth ..... 119/166
5,613,660 A * 3/1997 Wyatt ..... 248/300
5,673,811 A * 10/1997 Dickinson et al. ..... 220/812
5,695,084 A * 12/1997 Chmela et al. ..... 220/212
5,705,212 A * 1/1998 Atkinson ..... 426/115
5,706,974 A * 1/1998 Murdick et al. ..... 220/735

(Continued)

*Primary Examiner*—Anthony Stashick
*Assistant Examiner*—Ned A Walker
(74) *Attorney, Agent, or Firm*—Lempia Braidwood LLC

(57) ABSTRACT

A storage bin comprises a cover panel and a scoop. The cover panel may be slidably or rotatably moved to expose the interior of the storage bin. The scoop is stored internally in the storage bin and is exposed when the cover panel is open. The design of the cover panel provides advantages to consumers by providing a durable and versatile method of access to the contents of the storage bin. The storage of the scoop within the storage bin limits contamination of the scoop during storage and provides easy access to the scoop when the cover panel is open. A reusable labeling surface allows the consumer to conveniently identify a variety of stored items over the storage bin's lifetime.

14 Claims, 4 Drawing Sheets

U.S. PATENT DOCUMENTS

D416,438 S * 11/1999 Molo ..... D7/392
6,604,645 B1 * 8/2003 Vaupotic ..... 220/212
D483,988 S * 12/2003 Kipperman et al. ..... D7/391
2004/0189026 A1 * 9/2004 Denham et al. ..... 294/1.3
2004/0217116 A1 * 11/2004 Offerman et al. ..... 220/345.2
2006/0000840 A1 * 1/2006 Kipperman et al. ..... 220/735
2008/0041861 A1 * 2/2008 Crawford et al. ..... 220/697

* cited by examiner

STORAGE BIN WITH MOVEABLE LID AND ATTACHED SCOOP

REFERENCE TO RELATED APPLICATIONS

This application claims priority to U.S. Provisional Application No. 60/632,874, filed Dec. 3, 2004, as to all subject matter commonly disclosed therein.

BACKGROUND OF THE INVENTION

1. Field of the Disclosure

The present disclosure is generally directed to storage containers, and more particularly, to a storage bin and lid construction.

2. Description of Related Art

Existing storage bins are known that are useful as food or cooking ingredient bins. Some of these types of bins have a cover with a lid construction that can be opened either by sliding the lid rearward or by flipping or pivoting the lid upward. Problems with these types of bins are known to be in the durability and functionality of the existing lid configurations. Currently known bin lids tend to break where the lid pivots and slides. Once broken, the lid becomes very difficult to open and close in any manner.

In addition, a scoop is typically used to remove quantities of the ingredients or other matter stored in the bin. Convenient storage for the scoop is virtually non-existent in current storage bins of this type, except that a user may drop a scoop into the bin interior for the next use. The scoop can be difficult to retrieve from the bin because of the size of the lid opening and/or when the level of the stored material in the bin is low. Also, when the scoop is dropped into the contents of the bin, the handle of the scoop often contacts or sinks below the surface of the bin contents. Retrieval of the scoop often detrimentally results in the user's fingers or hands coming into contact with the bin contents as he or she reaches for the handle. Further, these bins typically do not offer a practical solution for identification (labeling) of the ingredients or material stored in the bin.

The lids of some of these known storage bins provide a user the option of pivoting or rotating the lid upward to an open position, or sliding the lid rearward to an open position. This dual function lid design has to date compromised both opening actions and resulted in lower consumer satisfaction with the products.

Some end users use pre-existing containers for ingredient and other material storage. For example, BRUTE® trash containers and used pickle buckets are often used by consumers to store food ingredients and the like. Also, rotational-molded containers are being sold and used as ingredient bins.

BRIEF DESCRIPTION OF THE DRAWINGS

Objects, features, and advantages of the present disclosure will become apparent upon reading the following description in conjunction with the drawing figures, in which.

DETAILED DESCRIPTION OF THE DISCLOSURE

Figure 1:
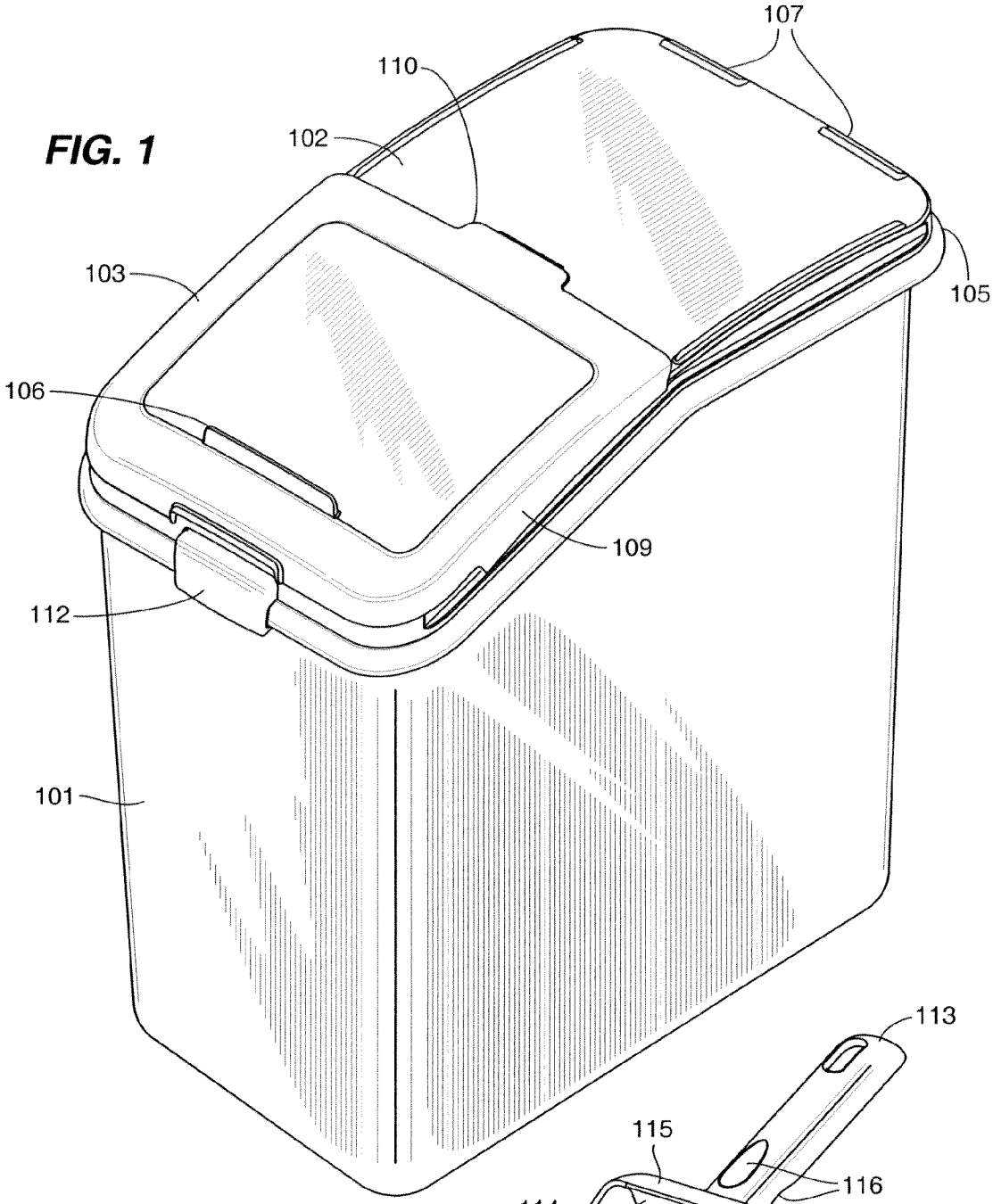
FIG. 1 shows a top and front perspective view of one example of a storage bin constructed in accordance with the teaching of the present disclosure.

The present disclosure includes two embodiments. In a first example of the disclosed storage bin, the lid does not pivot, but instead only slides rearward to the open position. Elimination of the pivot-open feature can enhance the sliding ability, function, and durability of the lid. Consumer research has found that a vast majority of users of such bins with dual function lids never employ or utilize the pivot-open lid function. In a second example of the disclosed storage bin, a bin lid includes both the pivoting and sliding functions, but has a robust slide a pivot construction.

As shown generally in FIGS. 1-5, the bin having a slide-only lid (103) construction includes an outwardly projection rim or track (105) extending around the front half of the cover (102) to provide a full-length slide for the lid (103). As shown generally in FIG. 6, a third piece or skate (218) is employed with the cover (102) and lid (103). The skate (218) slides along a track (105) on the back lid (219). The lid (217) pivots on the skate (218) and can be rotated to the flipped-open position, with the skate (218) and lid (217) positioned anywhere along the track (105). A scoop holster or hook (108) can be provided for storing and supporting the scoop (108) in either example.

In the example of FIGS. 1-4, the bin has a cover (102) closing off an open end of the storage bin base (101). The cover (102) has a front section with an opening and a closed back section. A lid (103) can be slid forward or rearward along the edges or track (105) of the cover (102) to either close off the opening, as in FIG. 1, or provide access to the opening, as in FIG. 3.

Figure 2:
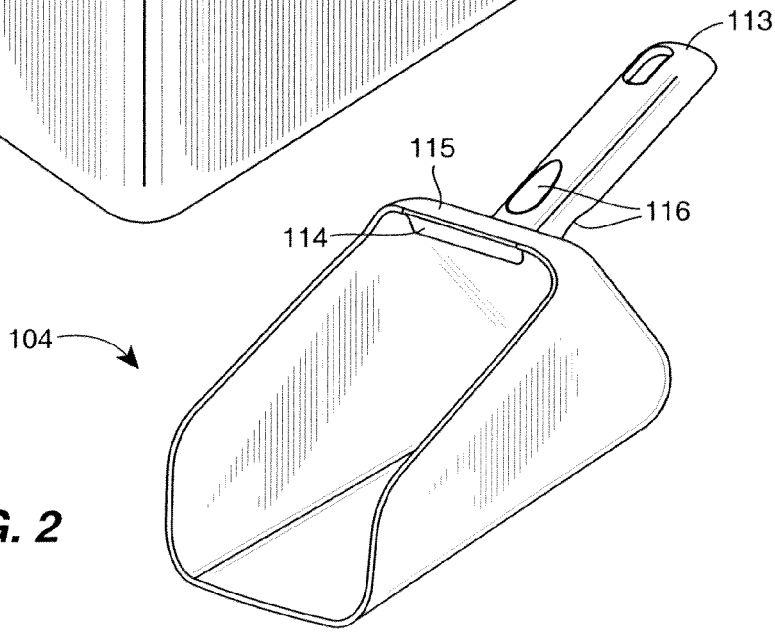
FIG. 2 shows a front perspective view of a scoop which may be stored in the storage bin of FIG. 1.
Figure 3:
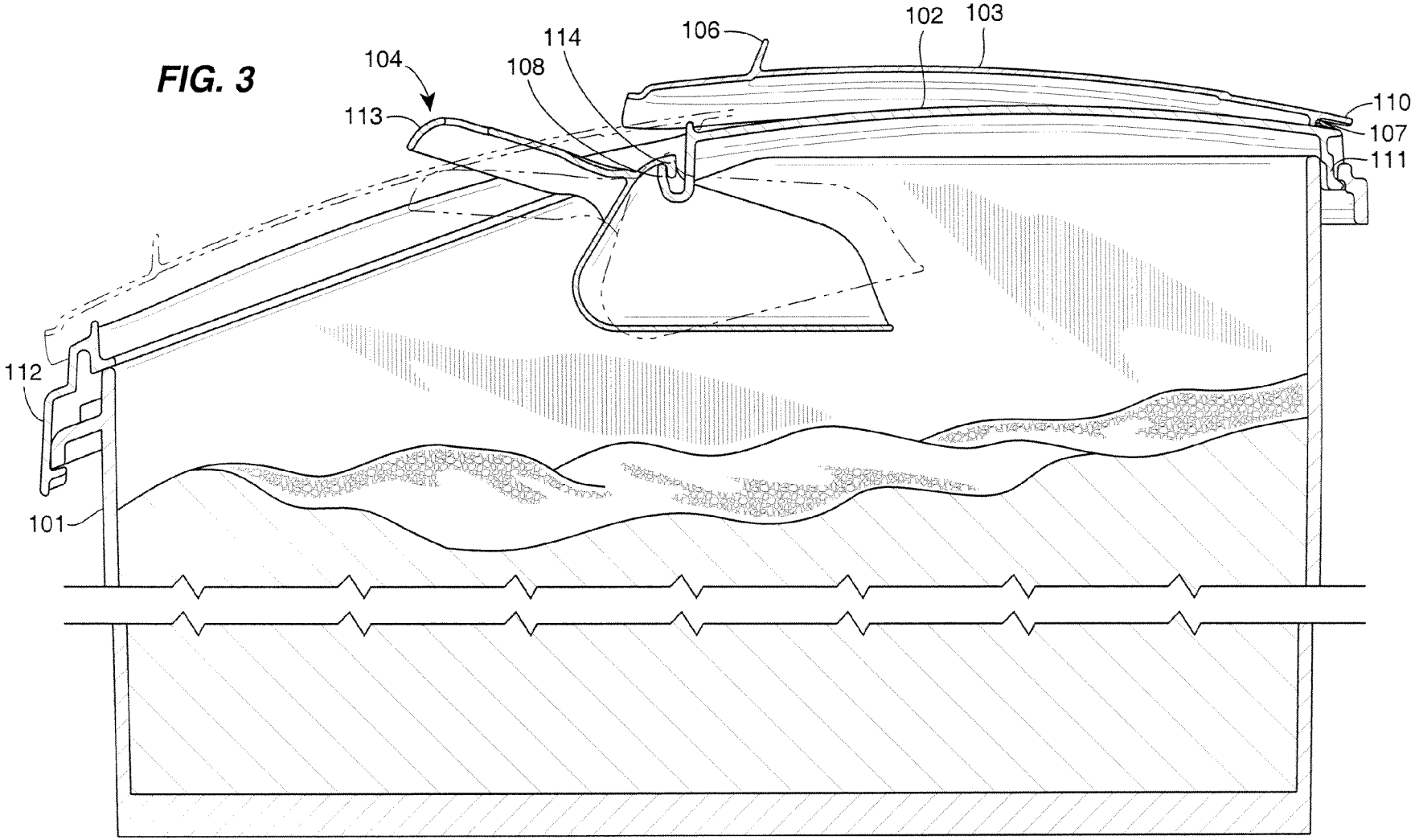
FIG. 3 shows a side cross sectional view of the storage bin of FIG. 1 and the scoop shown in FIG. 2 stored therein.
Figure 4:
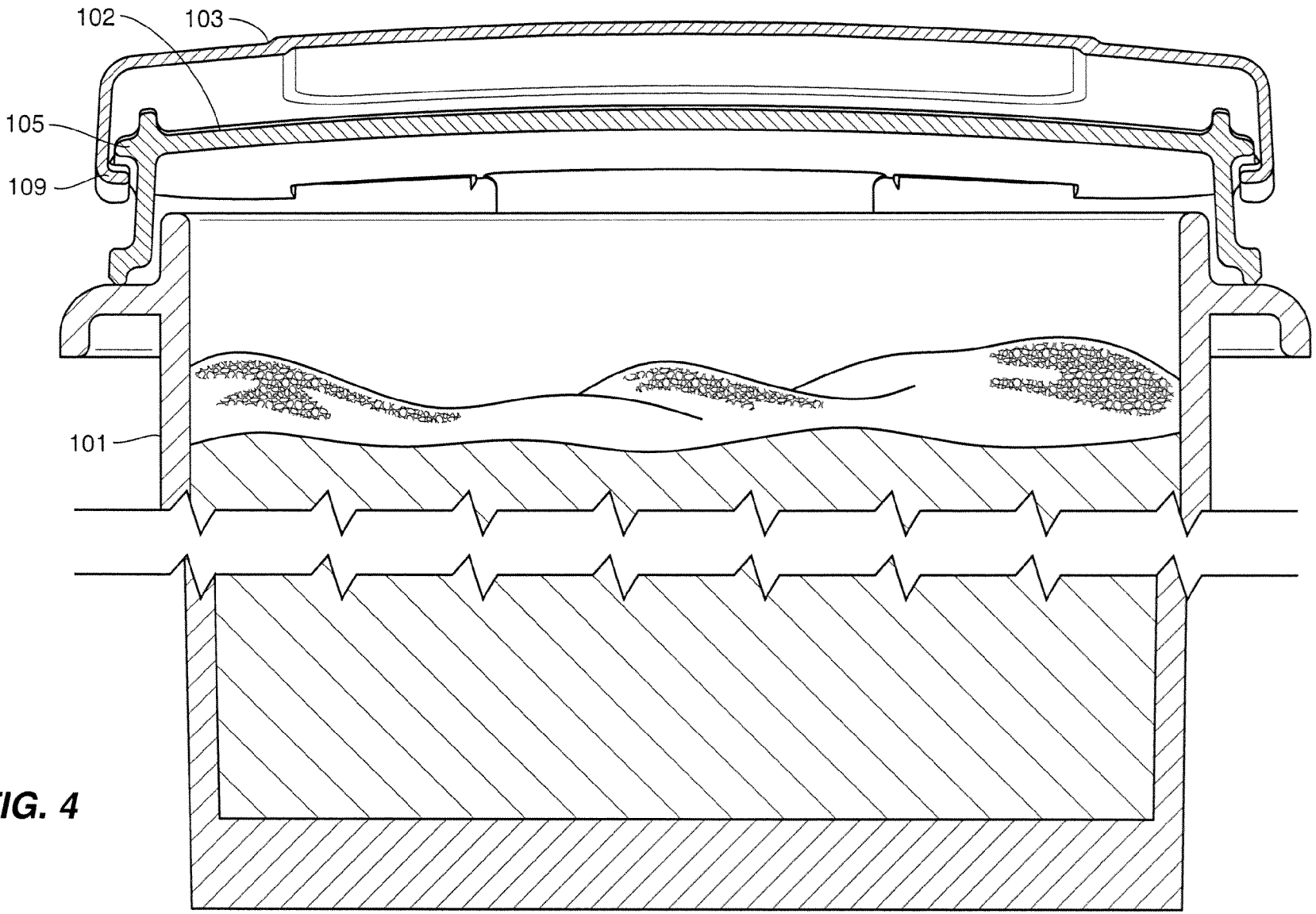
FIG. 4 shows a front cross-sectional view of the storage bin of FIG. 1.
Figure 5:
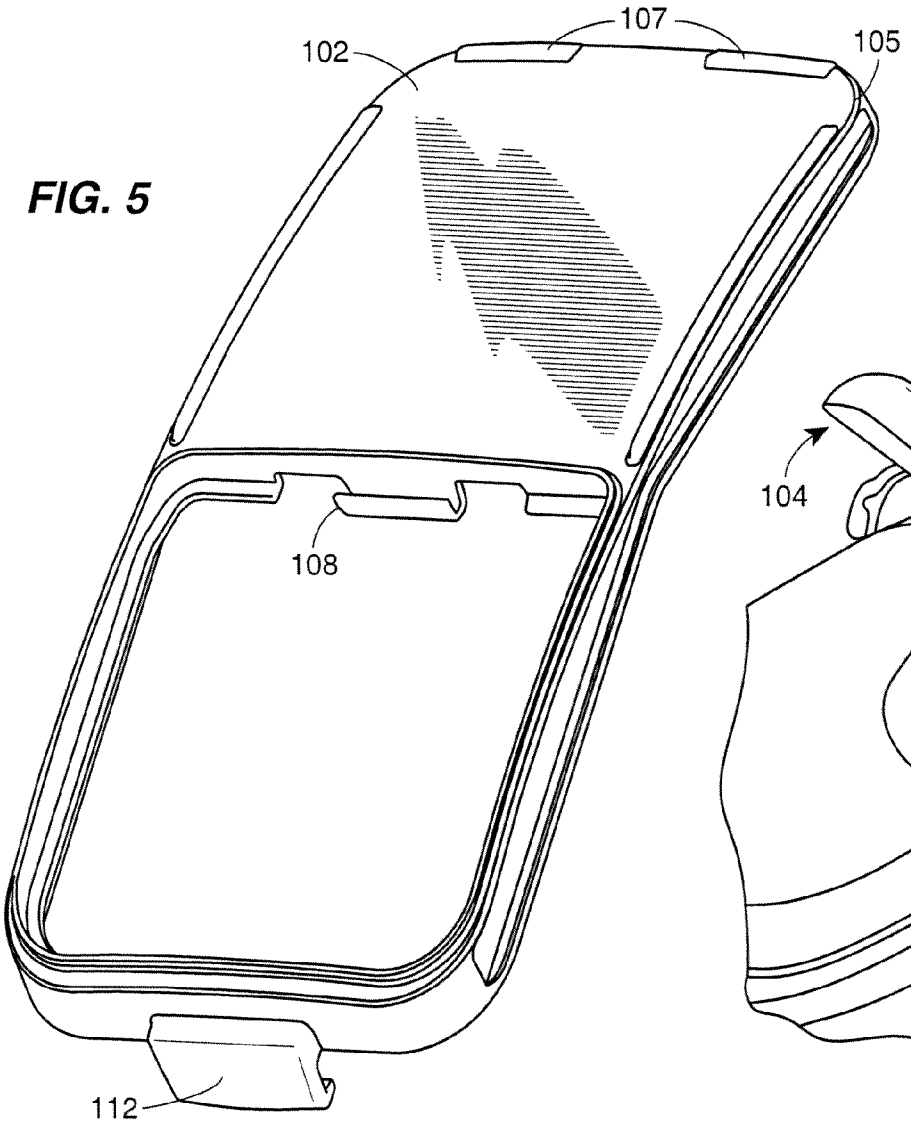
FIG. 5 shows a top perspective view of the lid of the storage bin of FIG. 1.

In addition, a scoop (104) as shown in FIG. 2 can be stored in a manner within the bin that is approvable under the National Sanitation Foundation (NSF) International standards. As shown in FIGS. 3 and 5, a hook (108) is provided on the bottom side of the cover (102) adjacent the opening. The scoop (104) has a corresponding, forward facing complimentary hook or lip (114) that can suspend or hang from the hook (108) inside the bin base (101) to protect the scoop (104), as well as the bin contents, from contamination.

To open the lid (103), the end user can grab a handle or upwardly extending flange (106) on the clear PC (polycarbonate) lid door (103). In this example, the lid (103) has a depending skirt that helps to seal the lid (103) over the opening in the cover (102). The lid (103) can be lifted, in this example, about one inch or less, until the skirt is clear of the cover rim. A slide or track (109) on the lid (103) can then engage the slide or track (105) in the cover (102) and then the user can slide the lid back until it engages a stop (107) on the back section of the cover, as shown in FIG. 3. The lid (103) on its back edge can have a tab (110) for engaging the stop, if desired, and as shown in FIGS. 1 and 3. The tab (110) will bear against the stop (107) to stop the lid in the fully open position.

The scoop (104) in this example is configured such that the scoop handle (113) tilts upward when hanging from the hook (108) as seen in FIG. 3. When the lid is open (represented by the dashed lines in FIG. 3), the scoop handle (113) is free to tilt upward, as shown in dashed lines, so that it can be easily reached and grasped by a user. When the lid (103) is closed (represented by the solid lines in FIG. 3), the lid (103) pushes the scoop handle (113) downward, and the weight of the scoop (104) pushes the scoop handle (113) against the underside of the PC lid door (103). Thus, when the lid (103) is in a closed orientation, the scoop handle (103) is borne against an underside of the cover panel. When the lid (103) is opened, the scoop (104) is free to rotate again into its normal resting position. Thus, the scoop handle (113) swings up and presents itself to the user for better accessibility. In other words, the scoop handle (113) rises to an exposed orientation for grasping when the cover (102) is in the open orientation.

To clean the storage bin, the lid door (103) can be removed from the cover (102) and the cover (102) can be removed from the bin base (101). To remove the lid door (103) from the cover (102), the user can slide open the lid door (103) until it engages the stop (107). The user can then lift the tab (110) on the back of the lid door (103) and push the door (103) back to overcome the stop (107). This will allow the door (103) to slide off the back end of the lid (103). The process would be reversed to reinstall the lid door (103). To remove the cover (102), the end user can push in a tab (111) that is underneath a rim of the base (101) in the back of the storage bin as shown in FIG. 3. The user can then lift the back of the cover (102) off the base. The cover (102) then can slide forward to disengage a hook (112) on the front end of the cover (102) from the base (101). This process also would be reversed to attach the cover (102) on the bin base (101).

In this example, there is a flat area on the forward hook (112) on the cover (102) that may be used as a label area. One issue with conventional labels is that all current labels on storage bins are permanent, despite the fact that a bin is rarely used for the same ingredient throughout its life. This means the labels eventually will not represent the ingredients or materials stored in the bin. The flat area of the forward hook (112) of the storage bin of the present disclosure provides an opportunity to attach and selectively replace a semi-permanent label in this area as needed. In another embodiment, this label area can be provided with a surface, such as an in-molded blank dry-erase surface. The dry-erase surface can be marked with special dry-erase ink and erased and re-marked as often as needed by the end user. Alternatively, other special ink markers could be used to write on the integral plastic label area, whereby the marker ink could be readily erased and re-marked as needed. Special label stickers could also be provided along with the storage bins, if desired. As another alternative, the labeling location could be provided on the PC lid door (103) or on the bin base (101).

With regard to the scoop (104), the disclosed example has the complementary hook or lip (114) in order to hang from the cover (102). The lip or hook (114) is provided on a flange or dam (115) that helps to better safeguard the handle (113) from the material that is being scooped. This also advantageously reduces the contamination risk for the scoop (104). In addition, a thumb scoop and trigger notch (together as 116) are provided on the handle (113) for improved ergonomic form of the scoop (104) and handle (113).

Figure 6:
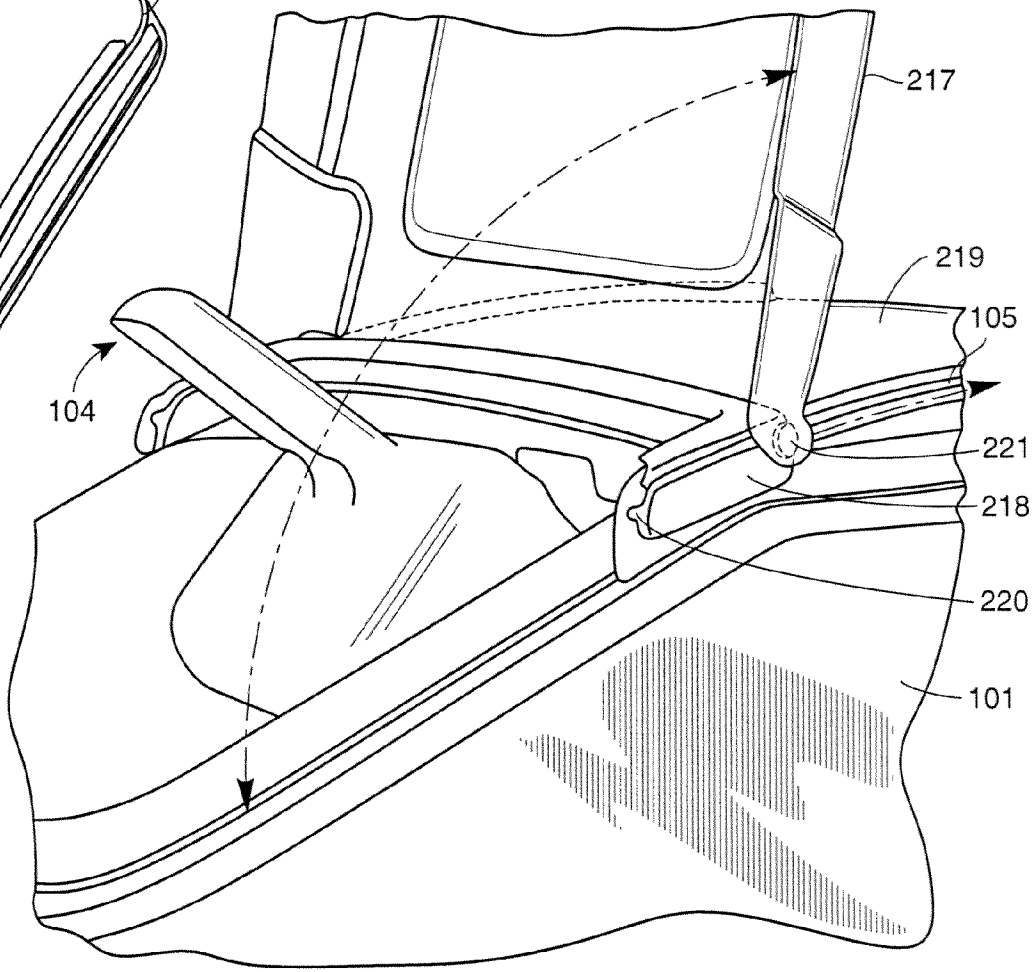
FIG. 6 shows a top and front partial perspective view of another example of a storage bin constructed in accordance with the teachings of the present disclosure.

In the second example of FIG. 6, the only differences are noted with new references numbers in the drawing. For example the scoop (104) hangs from a hook (108) located on a forward edge of the back section of the cover (219). The skate (218) depicted in FIG. 6 has a track or slide (220), similar to the track (109) of the lid (103), but instead provided on the skate (218) and not the edges of the lid (217). The skate (218) slides along the track or slide (105) of the cover in the slide-open action. The skate (218) also has a pivot connection (221) coupled to the lid (217). Thus, as shown in FIG. 6, the lid (217) can optionally pivot or rotate to an open position. The skate (218) provides complete separation of structures between the lid (217) slide function and the lid (217) pivot function. Thus, either function can be utilized without compromising or affecting use of the other function.

The cover (219) in this example also has a different front attachment arrangement. In this example, the lid (217) pivots open leaving no other cover (218) part in the front area of the bin. When closed, the lid (217) can snap over a pair of tabs to secure the lid (217), and hence the cover (219), in place.

The disclosed products can in one example be injection molded from a plastic or from different plastic materials. The covers and/or lids can be made from PP (polypropylene), PE (polyethylene) or other materials as desired to reduce cost and to better facilitate a smooth slide. In the example of FIG. 6, the back section of the cover (219) can be made from PP, PE, PC, or other materials as desired. The PC door lid and the scoop in either example can be made from clear PC to impart visibility to the ingredients within the bin and the scoop, when used. The skate (218) in the second example can be made from an engineering-grade plastic such as Nylon, DELRIN®, PC, or the like.

The disclosed storage bins can also be made as a thermoformed product or a vacuum-formed product, if desired and suitable for the intended use of the bin. It is also possible to form the lids, covers, and/or bin base from different materials from one another, and also to form any or all of the components from other suitable materials such as stainless steel or the like.

The disclosed storage bins are quite suitable as food or ingredient storage containers or bins. The disclosed examples of a bin improve upon or solve problems with the known bins because the lids can slide open and be closed more easily without risk of binding or breaking. Also, the addition of the internal scoop storage is a significant improvement over prior known bins. Provision for change in labeling during the useful life of the disclosed bins is also an advantage over prior known bins. Also, in the second example, the dual opening function lid configuration is a very robust improvement over prior known designs where the lid can both pivot and slide.

Although certain storage bin constructions have been described herein in accordance with the teachings of the present disclosure, the scope of coverage of the appended claims is not limited thereto. On the contrary, the claims of this patent cover all embodiments of the teachings of the disclosure that fairly fall within the scope of permissible equivalents.

What is claimed is:

1. A storage bin comprising:

(a) a base, the base comprising a bottom, an upstanding side wall, and a top opening at a top end of the side wall;

(b) a cover attached to the base, the cover comprising a fixed panel with a closed back section, a front section, an opening through the front section, and a lid movably connected to the fixed panel, wherein:

(i) the cover and the base define a storage space;

(ii) the cover covers the entire top opening of the base when the lid is in a closed orientation; and, (iii) the lid provides access to the storage space through the opening of the cover in an open orientation;

(c) a scoop, the scoop comprising a handle, a scoop section, and a retainer; and, (d) a scoop support carried by a portion of the fixed panel, wherein:

(i) the scoop is suspended by the retainer from the scoop support;

(ii) the scoop is within the storage space when the lid is in the closed orientation and the scoop section is within the storage space when the lid is in the open orientation; and, (iii) a portion of the scoop rotates upward relative to the top opening when the lid is moved to the open orientation.

2. A storage bin according to claim 1, wherein the lid further comprises a track and a skate, further wherein:

(a) the track is in sliding communication with the skate; and, (b) the cover panel and skate are hingedly attached.

3. A storage bin according to claim 2, wherein the storage space of the storage bin is capable of either a sliding or rotating transition between the closed orientation and the open orientation.

4. A storage bin according to claim 3, wherein the storage space of the storage bin is simultaneously capable of both a sliding and rotating transition between the closed orientation and the open orientation.

5. A storage bin according to claim 1, wherein the cover further comprises a track in sliding communication with the lid.

6. A storage bin according to claim 5, wherein the track extends substantially the entire length of the cover.

7. A storage bin according to claim 5, wherein the cover is capable of a sliding transition between the closed orientation and the open orientation.

8. A storage bin according to claim 1, wherein a portion of the scoop is exposed for grasping when the cover is in the open orientation.

9. A storage bin according to claim 8, wherein the exposed portion of the scoop is the handle of the scoop.

10. A storage bin according to claim 1, wherein at least a portion of the scoop section is shielded from the storage bin contents when the cover is in the closed orientation.

11. A storage bin according to claim 1, wherein the storage bin further comprises a reusable label surface.

12. A food ingredient storage bin comprising:

(a) a base, the base comprising a bottom, an upstanding side wall extending upward from a perimeter of the bottom, an interior storage space above the bottom within the side wall, and a top opening at a top end of the side wall;

(b) a cover attached to the top end of the base, the cover comprising a fixed panel, an access opening through the fixed panel, and a movable cover panel connected to the fixed panel, the fixed panel and cover panel together covering the top opening with the cover panel in a closed orientation and the cover panel providing access to the storage space through the access opening in an open orientation;

(c) a scoop, the scoop comprising a handle, a scoop section, and a retainer lip carried generally between the handle and scoop section; and (d) a hook depending from an edge of the fixed panel of the cover; wherein:

(i) the scoop is suspended by the retainer lip from the hook within the interior storage space;

(ii) the handle of the scoop is borne against an underside of the cover panel when the lid is in the closed orientation; and (iii) the handle is not borne against the underside of the cover panel, and rotates to an exposed orientation in the access opening for grasping when the cover panel is moved to the open orientation.

13. The food ingredient storage bin of claim 12, wherein the cover further comprises a track attached to the fixed panel, further wherein the track and movable cover panel are in sliding communication.

14. The food ingredient storage bin of claim 12, wherein the lid further comprises a track attached to the fixed panel and a skate in sliding communication with the track, further wherein the skate and movable cover panel are hingedly attached.

* * * * *